US010875027B2

(12) United States Patent
Barber

(10) Patent No.: US 10,875,027 B2
(45) Date of Patent: Dec. 29, 2020

(54) SIZER TOOTH

(71) Applicant: MMD Design & Consultancy Limited, Somercotes (GB)

(72) Inventor: Richard Paul Barber, Alfreton (GB)

(73) Assignee: MMD Design & Consultancy Limited, Somercotes (GB)

( * ) Notice: Subject to any disclaimer, the term of this patent is extended or adjusted under 35 U.S.C. 154(b) by 328 days.

(21) Appl. No.: 15/764,447

(22) PCT Filed: Sep. 30, 2016

(86) PCT No.: PCT/GB2016/053047
§ 371 (c)(1),
(2) Date: Mar. 29, 2018

(87) PCT Pub. No.: WO2017/055864
PCT Pub. Date: Apr. 6, 2017

(65) Prior Publication Data

US 2018/0297033 A1 Oct. 18, 2018

(30) Foreign Application Priority Data

Oct. 2, 2015 (GB) ..... 1517407.1

(51) Int. Cl.
*B02C 4/08* (2006.01)
*B02C 4/20* (2006.01)
(Continued)

(52) U.S. Cl.
CPC ..... *B02C 4/08* (2013.01); *B02C 4/20* (2013.01); *B02C 4/30* (2013.01); *B02C 13/06* (2013.01); *B02C 13/28* (2013.01); *B02C 13/2804* (2013.01)

(58) Field of Classification Search
CPC ..... B02C 13/06; B02C 13/28; B02C 13/2804
(Continued)

(56) References Cited

U.S. PATENT DOCUMENTS 1,713,609 A * 5/1929 Krider ..... B02C 4/305 241/294
2006/0261202 A1* 11/2006 Potts ..... B02C 4/18 241/236

(Continued)

FOREIGN PATENT DOCUMENTS

CN 201154311 * 11/2008
CN 201154311 Y 11/2008

(Continued)

OTHER PUBLICATIONS

Bian, Translation of CN 201154311 (Year: 2008).*
Kopacz, Ireneusz, "International Search Report," prepared for PCT/GB2016/053047, dated Dec. 13, 2016, three pages.

*Primary Examiner* — Adam J Eiseman
*Assistant Examiner* — Bobby Yeonjin Kim
(74) *Attorney, Agent, or Firm* — Shackelford, Bowen, McKinley & Norton, LLP

(57) ABSTRACT

A sizer tooth assembly for a mineral sizer is described. The tooth assembly includes a horn protrusion extending from a rotatable support, the horn protrusion having a pair of opposed front and rear faces; and a shell structure encapsulating the horn protrusion and defining the outer shape of the sizer tooth; wherein the shell structure comprises exactly two cover formations which are non-releasably secured to one another but not to the horn protrusion, to define when so secured a unitary tooth assembly. Each of the two cover formations seats upon and presents an inward engagement face to a respective one of the pair of opposed front and rear faces of the horn protrusion; and each such engagement face of a cover formation and its corresponding face of the horn protrusion are provided with a complementary arrangement of projections and recesses configured such that when the two cover formations are non-releasably secured to one another the shell structure is releasably connected upon the (Continued)

horn protrusion. A mineral sizer including such tooth assemblies and a method of constructing such a tooth assembly and especially of constructing a replacement for repair are also described.

20 Claims, 6 Drawing Sheets

(51) Int. Cl.
*B02C 4/30* (2006.01)
*B02C 13/06* (2006.01)
*B02C 13/28* (2006.01)

(58) Field of Classification Search
USPC ..... 241/294
See application file for complete search history.

(56) References Cited

U.S. PATENT DOCUMENTS

2012/0012688 A1* 1/2012 Barber ..... B02C 4/30 241/291
2012/0132740 A1* 5/2012 Cascio ..... B02C 4/08 241/278.1
2014/0117133 A1 5/2014 Emmerich et al.
2016/0290134 A1* 10/2016 Johnson ..... E02F 9/2825
2017/0043347 A1* 2/2017 Berglund ..... B22F 1/0003
2017/0087558 A1* 3/2017 Davis ..... B02C 18/18
2017/0136468 A1 5/2017 Barber
2018/0297033 A1* 10/2018 Barber ..... B02C 4/30

FOREIGN PATENT DOCUMENTS

DE 20208107 U1 10/2002
EP 0167178 A2 1/1986
EP 2620218 A1 7/2013
RU 2342194 C2 12/2008
RU 2378054 C2 1/2010
RU 2408429 C2 1/2011
WO WO-03/006165 A1 1/2003
WO WO-2005/046875 A1 5/2005
WO WO-2016001684 A1 1/2016

* cited by examiner

SIZER TOOTH

The present invention relates to a sizer tooth assembly for a mineral sizer or breaker; and to a drum assembly for a mineral sizer or breaker that includes a plurality of such teeth. The invention is primarily, though not exclusively, concerned with tooth assemblies and drum assemblies for use with mineral sizers or breakers of the general type disclosed in the applicant's European patent No. EP0167178.

In this type of mineral sizer, mineral lumps of various size, hardness and material type are broken down into smaller pieces by gripping the lumps and applying tensile forces to cause the lump to break in a snapping action. In this type of apparatus, each sizer tooth is repeatedly exposed to large breaking forces sequentially applied onto the front and rear of the tooth portion respectively.

In order to enable each tooth to withstand such breaking forces it is desirable that they are constructed so as to have a core formed of a ductile metal covered with a tooth shell of a harder and more wear resistant material. In order to be capable of breaking minerals, and particularly hard minerals, it is necessary to be able to transmit, from a drive shaft, relatively large forces, and a strong and resilient tooth body is needed. However in order to deal with abrasive minerals over time, a highly wear resistant tooth surface is required. The core and shell arrangement enables materials to be optimised to both requirements.

The wear resistant material of the tooth shell does still wear over time, and it can then become necessary to replace it.

The applicant has previously proposed a tooth construction for a mineral sizer in its international patent publication No. WO2005/046875 A1. Disclosed therein is a tooth shell comprising a number of cover plates each of which are welded directly to an underlying horn protrusion extending from a drum annulus. Direct welding to the horn is advantageous insofar as it provides a means of securely fixing the tooth shells in a manner which can withstand large impact forces. However, such an arrangement can be inconvenient or problematic when, after a period of use, it subsequently becomes necessary to remove a tooth shell structure, e.g. in the event of a replacement shell being required due to wear. Indeed, in the arrangement disclosed in the aforementioned document, only a top cover portion of the tooth shell can be readily removed and replaced by means of a gouging tool inserted into recess provided along a weld seam.

An alternative modular construction has been proposed in applicant's international patent application No. WO2016/001684A1. The horn is adapted by provision of recesses in its front and rear faces in the form of rectangular key ways to receive elements of a modular tooth shell assembly. The tooth shell assembly is a modular structure formed of multiple components comprising intermediate top, intermediate front and side covers positioned over the horn protrusion and outer front, rear and top covers, the last formed in two parts.

The modules of the sub-assembly are welded to each other to so as form an integral whole which is thereby passively fixed to the horn. Replacement of the cover shell assembly is effected by removal of the outer covers. The use of separate outer and intermediate covers reduces material discard.

Although the system of WO2016/001684A1 eliminates a need to weld the cover assembly directly to the horn, and consequently the requirement to destroy such welds for replacement and thus can simplify removal for replacement of worn parts to some extent, multiple surfaces of the plural modules still need to be welded, and multiple such welds need to be destructively removed when it is time for the shell cover structure to be replaced. Also careful alignment of the keying positions of the assembly with the keyways in the horn is required. The process remains quite labour intensive.

There is a general desire to provide a tooth shell construction forming the outer working part of a mineral sizer tooth that facilitates removal of the shell construction for replacement after a prolonged period of wear, and in particular that reduces the labour associated with the removal of welds in order to remove worn shell components.

According to a first aspect of the present invention there is provided a sizer tooth assembly for a mineral sizer, the tooth assembly including a horn protrusion extending from a rotatable support, the horn protrusion having a pair of opposed front and rear faces; and a shell structure encapsulating the horn protrusion and defining the outer shape of the sizer tooth; wherein the shell structure comprises exactly two cover formations which are non-releasably secured to one another, for example by a welded joint on one or more mutually adjacent surfaces, but not to the horn protrusion, to define when so secured a unitary tooth assembly; and wherein each of the two cover formations seats upon and presents an inward engagement face to a respective one of the pair of opposed front and rear faces of the horn protrusion; and wherein each such engagement face of a cover formation and its corresponding face of the horn protrusion are provided with a complementary arrangement of projections and recesses configured such that when the two cover formations are non-releasably secured to one another the shell structure is releasably connected upon the horn protrusion.

The releasable connection is for example provided by at least one projection, extending from an engagement face of the cover and/or a corresponding face of the horn protrusion, receivable within at least one complementary recess provided in the adjacent engagement face of the cover and/or corresponding face of the horn protrusion.

In the context of the present invention, the phrase "non-releasably secured" as used above refers to a means of securing which can only be reversed by forcible and irreversible destructive methods. In accordance with the invention the two cover formations are non-releasably secured to one another but are not non-releasably secured to the horn protrusion. In particular in the preferred case, the two cover formations are non-releasably secured by provision of a welded joint between one or more mutually adjacent surfaces and the joint can therefore only be reversed by destruction of the weld e.g. by gouging a weld seam.

By contrast, the phrase "releasably connectable" used above refers to a means of connection which is readily reversible without resulting in destruction of the interconnected parts, for example by provision of complementarily shaped projections and recesses so configured that when the two cover formations are non-releasably secured together in situ each cover formation engages upon the horn protrusion in that the projections and recesses are configured such that one or more faces of the respective projections and recesses engage against one another for example in intimate face to face contact for example to create an interference fit.

In accordance with the principles of the invention it is not necessary to connect the cover formations that define the tooth surface in a non-releasable manner, for example by welding, to the horn protrusion. Instead, assembling together the two and only two cover formations in a non-releasable manner, for example by welding, to each other creates a cover structure that inherently also releasably secures onto the horn by means of the complementary arrangements of projections and recesses on each engagement face of a cover formation and its corresponding face of the horn protrusion.

The solution offered by the invention is one where the two cover formations of the cover are non-releasably secured only to each other, for example by welding, but thereby the cover as a whole, assembled in-situ on the horn protrusion, is releasably connected to the horn protrusion. This is achieved by the effect of the releasable connection provided by a protrusion extending from an inward engagement face of a cover formation or of a respective one of the pair of opposed front and rear faces of the horn protrusion, receivable within a complementary recess provided in the corresponding face of the horn protrusion or inward engagement face of the cover as the case may be. Thus, the act of non-releasably fixing together the two cover formations in-situ on the horn protrusion directly effects the releasable engagement of the assembled shell structure cover onto the horn protrusion. The releasable connection is provided by the complementary protrusions and recesses. The act of non-releasably fixing together the two cover formations in-situ on the horn protrusion creates an interference fit between the complementary projections and recesses that constitute the means of releasable connection of the assembled cover to the horn protrusion.

The two cover formations of the cover are thus in the preferred case configured to be attached non-releasably to one another in situ onto the horn protrusion in such manner that thereby the cover is passively and releasably attached to the horn protrusion by engagement between the extending protrusion extending from an inward engagement face of a cover formation or of a respective one of the pair of opposed front and rear faces of the horn protrusion and the complementary recess provided in the corresponding face or cover.

No other connection between the assembled cover and the horn protrusion is provided. In particular no non-releasable connection between the cover formations of the cover and the horn protrusion, whether by weld or otherwise, is created.

In accordance with the principles of the invention, the shell structure cover that defines the tooth surface is a modular assembly which when assembled in situ on the horn protrusion comprises two and only two cover formations. It is necessary only to join these two components to each other in non-releasable manner to form the tooth assembly. More significantly, it is necessary only to reverse this one non-releasable connection, for example by gouging of a welded connection between the two cover formations, to enable removal of the two cover formations for replacement for example when required through wear or damage. The labour involved in removal of the shell for replacement after a prolonged period of wear is much reduced when compared with prior art systems in which either a shell is welded to the horn directly or a large plurality of shell modules are welded to each other.

Each cover formation comprises a part of the outer tooth shell structure and so it is envisaged that both would be replaced after a prolonged period of wear. In consequence, the entire shell structure is discarded. This can be contrasted with modular arrangements such as proposed in WO2005/046875A1 and WO2016/001684A1 where the shell is deliberately provided in the form of a much larger plurality of modules so that only those parts subjected to most wear need to be removed for replacement. Such arrangements significantly increase the labour cost of replacement as multiple weld sites between the multiple modules must be destroyed to disassemble the shell structure.

The two cover formations constitute when non-releasably secured to one another, for example by a welded joint, the tooth shell structure that seats on and over the horn protrusion to provide a tooth surface structure.

The horn protrusion has a pair of opposed end faces. The shell structure as assembled in situ comprises first and second end cover portions adapted to overlie at least partly the opposed end faces of the horn protrusion, the end cover portions being in face to face contact with the respective opposed end faces of the horn protrusion via the said rearward engagement faces.

Optionally, the horn protrusion has a pair of opposed side faces. Optionally, the shell structure as assembled in situ comprises first and second side cover portions adapted to overlie at least partly the opposed side faces of the horn protrusion, an inward surface of each side cover portion being in face to face contact with the respective opposed side faces of the horn protrusion.

Optionally, the horn protrusion has a top face. Optionally, the shell structure as assembled in situ comprises a top portion adapted to overlie the top face of the horn protrusion, an inward surface the top portion being in face to face contact with the said top face of the horn protrusion.

The top portion of the shell structure typically comprises the primary structure for effecting engagement with a mineral to be sized/broken. The top portion is typically a tooth formation, for example of suitable familiar conformation. The tooth formation for example comprises a tooth body extending generally over and across the top surface of the horn protrusion and one or more forwardly extending tip or pick formations (where forwardly extending in this context means extending in a direction of intended rotation of the tooth formation in use) in a manner which will be familiar.

The tooth assembly in accordance with the invention is distinctly characterised in that at the point of assembly in-situ two and only two cover formations are brought together onto and over the horn protrusion, and the two cover formations are non-releasably secured together, and for example welded together, to form a shell structure on and over the horn protrusion in such a manner that the shell structure so assembled effects a releasable engagement onto and over the horn protrusion. Only this single non-releasable securing connection between the two cover formations needs to be effected at the time of assembly, for example in the form of one or more welded joints between the two and only two cover formations. More pertinently, only this connection needs to be destructively removed, for example by gouging the one or more welded joints, when it is desired to disassemble and remove the shell structure for replacement. The replacement process is much simplified.

It follows that prior to its assembly in-situ, each of the two cover formations that will make up the shell structure must be provided as a single integral construction. Optionally, each of the two cover formations may be fabricated as a monolithic one-piece casting. Alternatively, a cover formation may be otherwise fabricated into a single integral whole prior to assembly of the shell structure, for example in that it comprises component parts which have previously been permanently fabricated together.

The two cover formations when assembled together make up a shell structure that seats over and upon the horn protrusion and defines the principal wear surface of the tooth formation. For example such a shell structure includes first and second end cover portions and/or first and second side cover portions and/or a top portion for example including a tooth formation as above described.

Optionally, a first cover formation comprises a major part of the assembled shell structure and a second cover formation comprises a minor part. For example, a second cover formation comprises only one or other of the end cover portions, or a part thereof, and the first cover formation comprises the remainder of the shell structure for example including a remainder of the one end cover portion, first and second side cover portions and/or a top portion for example including a tooth formation as above described, and the other of the end cover portions.

Optionally, the two cover formations are provided with joining surfaces configured to be positioned adjacently face to face when each respective cover formation is in position on the horn protrusion. Such surfaces are provided to facilitate the non-releasable securing together of the two cover formations when each respective cover formation is in position on the horn protrusion and in particular constitute sites for such non-releasable securing. In particular, such surfaces are provided to facilitate the welding together of the two cover formations. In particular, such surfaces comprise one or more sites for weld seams between and joining the two cover formations. A clearance between the joining surfaces configured to be positioned adjacently face to face may be defined for such a weld seam.

It will be appreciated that whilst a weld seam can be removed, this can only be achieved forcibly and destructively, e.g. by a gouging tool as mentioned above.

Optionally a first cover formation defines a receiving slot into which a second cover formation is receivingly positioned with received surfaces of the second cover formation positioned adjacently to received surfaces of the receiving slot. The surfaces of the receiving slot and complementary received surfaces of the second cover formation together define joining surfaces and for example sites for weld seams between and joining the two cover formations as above described. For example a receiving slot in the first cover formation defines three planar surfaces, for example being a three-sided square or rectangular or trapezoidal slot.

In a possible embodiment a second cover formation comprises a part of one or other of a front or rear cover adapted to seat upon one or other end face of the horn protrusion, a first cover formation comprises a surrounding remainder of the said front or rear cover adapted to seat upon one or other end face of the horn protrusion and thereby defines a receiving slot into which the second cover formation is receivingly positioned.

In accordance with the invention, the assembled shell structure effects a releasable connection upon the horn protrusion as it is assembled in-situ in that each respective engagement face of a cover formation and its corresponding end face of the horn protrusion are provided with a complementary arrangement of projections and recesses.

Optionally, an inward engagement face of a cover formation is provided with at least one projection, a corresponding end face of the horn protrusion is provided with at least one recess, and the projection and recess are mutually configured such that the protrusion is received in the recess as the shell structure is assembled in-situ. For example, the projections and recess are mutually engageable in that one or more faces of the respective projections and recesses engage against one another for example in intimate face to face contact for example to create an interference fit into the recess when the shell structure is assembled by effecting a non-releasable connection of the two cover formations. Other surfaces may have clearance to facilitate location.

Optionally, a recess defines an inner volume with a closure lip extending over at least a part of a perimeter of the recess and a projection defines a complementary detent having an engagement surface that engages with an inner surface of the closure lip.

According to a second aspect of the invention there is provided a mineral sizer or breaker including a tooth assembly according to the first aspect.

According to a third aspect of the invention there is provided a drum assembly for a mineral sizer or breaker, the drum assembly including a plurality of toothed annuli mounted on a drive shaft, each annulus having a plurality of tooth assemblies according to the first aspect spaced about its circumference.

According to a fourth aspect of the invention there is provided a mineral sizer or breaker including a drum assembly according to the third aspect.

According to a fifth aspect of the invention, there is provided a method of assembling a sizer tooth for a mineral sizer or breaker, the method comprising:

providing a horn protrusion extending from a rotatable support, the horn protrusion being shaped to define a pair of opposed front and rear faces;

providing a shell structure comprising exactly two cover formations which are configured to be assemblable together to define when so assembled a unitary sizer tooth assembly;

defining on each of the two cover formations an inward engagement face which is presented to a respective one of the pair of opposed front and rear faces of the horn protrusion when the cover formation seats thereupon, wherein each such engagement face of a cover formation and its corresponding face of the horn protrusion are provided with a complementary arrangement of projections and recesses;

engaging each of the two cover formations onto the horn protrusion by means of the said projections and recesses;

non-releasably securing the two cover formations to one another, for example by welding one or more mutually adjacent surfaces, such that when the two cover formations are non-releasably secured to one another the shell structure is releasably connected upon the horn protrusion.

The method is a method of assembly of a shell structure onto a horn protrusion to provide a tooth assembly in accordance with the first aspect of the invention, and preferred features of the method will be understood by analogy with the foregoing discussion.

In particular, the method is characterised by the requirement to effect only a single non-releasable connection between the two cover formations, for example in the form of a welded joint between one or more adjacent surfaces of the two cover formations. The process of assembly is simplified, and more pertinently the process of disassembly is simplified as only this non-releasable connection needs to be destructively removed if the shell structure is to be disassembled and removed for replacement due to wear or damage. The shell structure is not welded or otherwise non-releasably connected to the horn. Instead, a passive releasable engagement is effected by the action of non-releasably fixing together the two cover formations that form the shell structure.

In a possible embodiment of the method, a first cover formation is urged into contact with a first end surface of the horn protrusion, for example by clamping, and a second cover formation is urged into contact with a second end surface of the horn protrusion, for example by clamping, and the two cover formations are thereby brought into contact with each other via one or more adjacent surfaces at which a non-releasable connection between them can be effected for example by welding. The assembled shell structure is thereby enabled to effect a passive but stable engagement onto the horn protrusion, for example in the form of an interference fit, that is nevertheless releasable merely by destructively removing the non-releasable join, such as the welded join, between the two cover formations.

It follows that in accordance with the invention in a sixth aspect, a method of replacement of a shell structure of a tooth assembly in accordance with the first aspect of the invention, or of a tooth assembly that has been fabricated in accordance with the method of the fifth aspect of the invention, comprises the destructive removal of the non-releasably secured join between the first and second cover portions, for example the destructive removal of the one or more welded joints between them, for example by gouging;

the provision of replacement first and second cover formations;

the performance of the foregoing method of the fifth aspect of the invention to attach the replacement cover formations in-situ on the horn protrusion.

Embodiments of the present invention will now be described, by way of example only, with reference to the accompanying drawings, in which.

Figure 1:
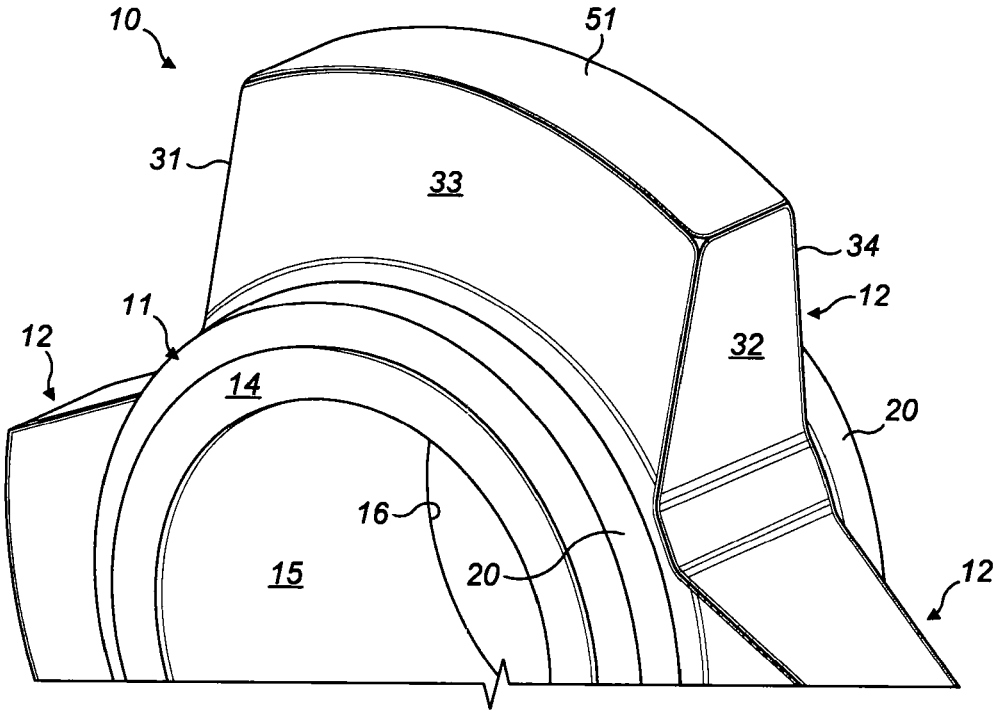
FIG. 1 is a part perspective view of a prior art drum annulus and horn protrusion.

Referring initially to FIG. 1, there is illustrated a known drum annulus 10 having an annular boss 11 from which a plurality of horn protrusions 12 project radially. The annulus 10 is illustrated as having four horn protrusions 12 spaced about its circumference (one of the horns not being shown). It is envisaged that the number of horn protrusions 12 may be greater or less than four; typically the number of horn protrusions 12 would be in the range of three to eight.

The horn protrusions 12 have a width in the axial direction which is less than the axial width of the annular boss 11 and are centrally located relative to the axial end faces 14, 16 of the boss 11. Accordingly, on both sides of the row of horns 12 the boss 11 defines an annular shoulder 20. Each horn protrusion is provided with a rear face 31, a front face 32, side faces 33, 34 and a top face 51.

The drum annulus 10 includes a through bore 15 which, in use, enables the annulus 10 to be slid onto a drive shaft. To construct a drum assembly for a mineral breaker, several drum annuli 10 are slid onto a drive shaft and each annulus 10 is fixedly secured to the shaft so as to be rotatable therewith.

Each annulus 10 can be secured to the draft shaft by welding. This is conveniently achieved by exposing a portion of the shaft between adjacent annuli and welding the annuli to the exposed portion of the shaft. Preferably the exposed portions of the shaft are defined by axially spacing opposed end faces 14, 16 of adjacent annuli and filling the resultant gap with weld. The annulus 10 may be forged in one piece from a suitable metal such that the boss 11 and horn protrusions 12 are integrally formed.

Figure 2:
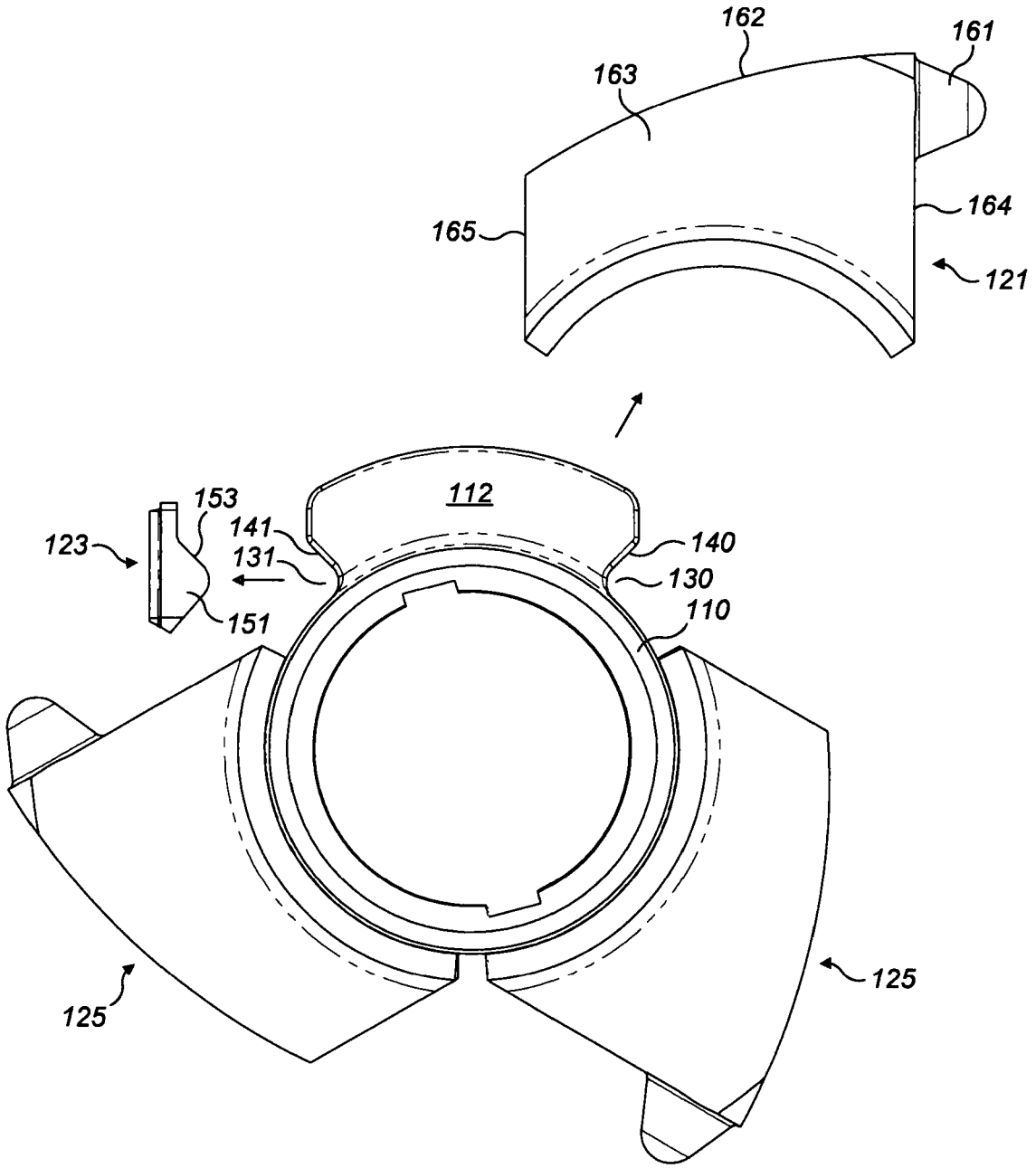
FIG. 2 is a perspective view of a drum annulus with horn protrusions and associated shell structures according to an embodiment of the present invention, shown partly disassembled.
Figure 3:
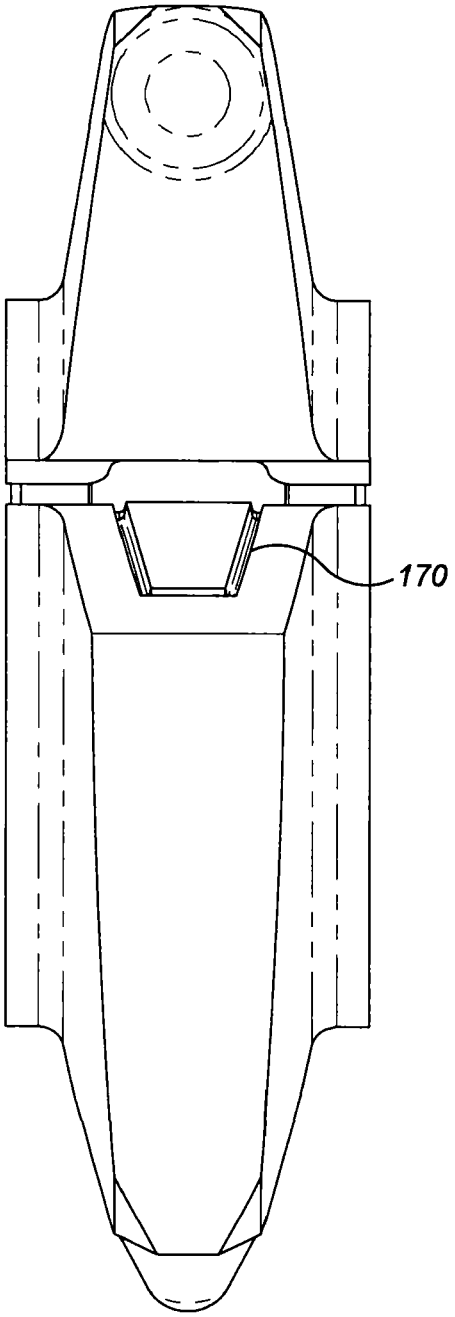
FIG. 3 is an end elevation of a shell structure as illustrated in FIG. 2 to exemplify the location of a welded connection between the first and second cover formations of the shell structure.
Figure 4:
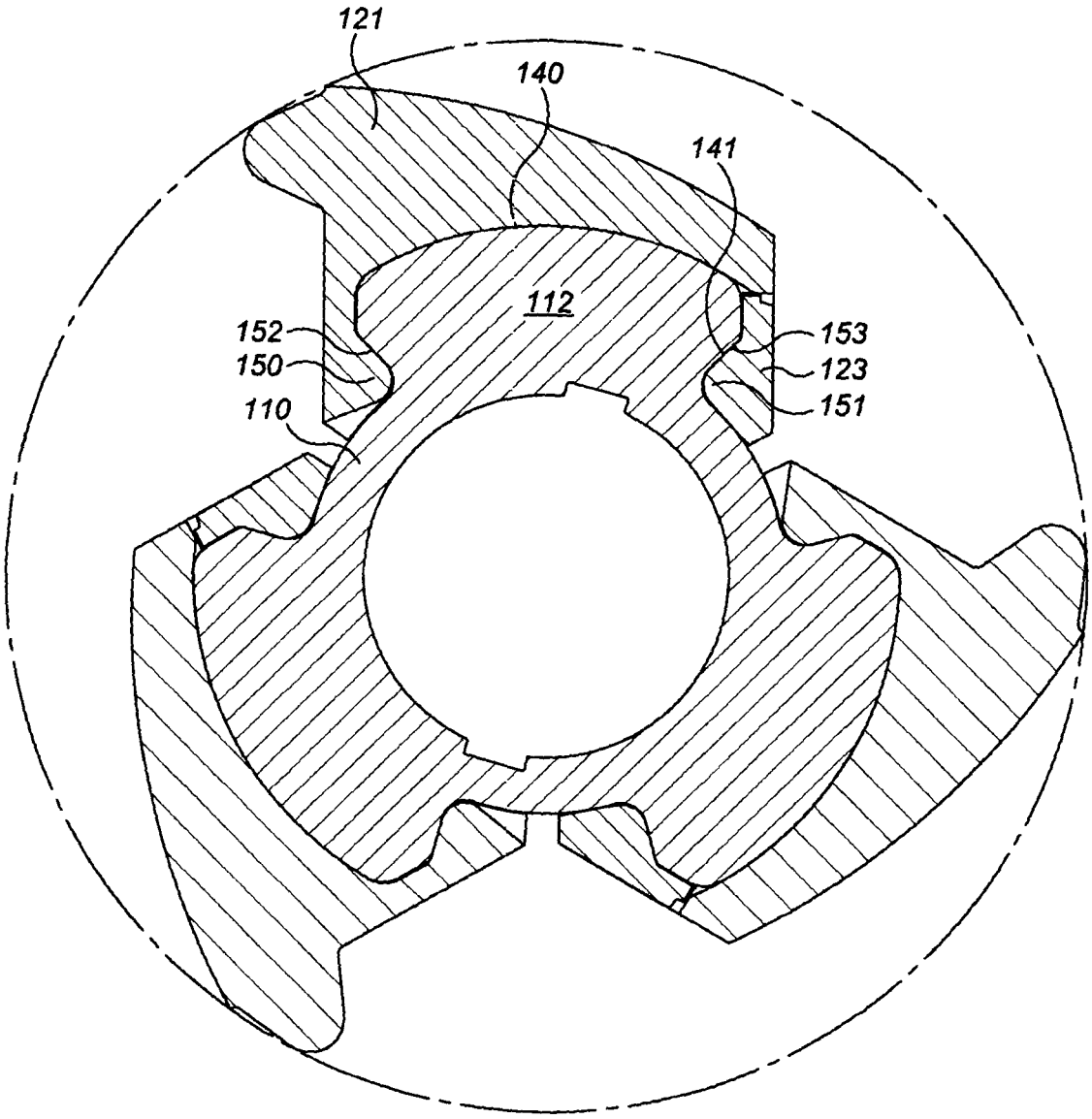
FIG. 4 is a cross-section through A-A of FIG. 3 illustrating three shell structures in position on three horn protrusions of a drum annulus in accordance with an embodiment of the invention.

FIGS. 2 to 4 illustrate a first embodiment in accordance with the present invention.

In the illustrated embodiment, a drum annulus 110 is provided with three circumferentially spaced horn protrusions 112, each of which is covered by a shell comprising two permanently connected cover formations.

FIG. 2 illustrates in perspective view this embodiment of the invention in which two of the three shell structures 125 have been assembled in-situ, and a third is shown prior to assembly on the horn protrusion 112, comprising a first cover formation 121 and a second cover formation 123. Each horn protrusion 112 has recesses 130, 131 formed in its front and rear faces which are shaped to define outwardly extending lips 140, 141. Complementarily shaped projections 150, 151 are respectively provided on inwardly facing surfaces of the two cover formations.

In the illustrated embodiment, the first cover formation 121 makes up a major part of the shell structure defining the tooth surface when assembled, including a top formation 162 with forwardly projecting breaking tip formation 161, side faces 163 and a forward face 164 that together cover corresponding top, side and forward faces of the horn protrusion 112. Additionally, a rear portion 165 of the first cover formation 121 partly extends across a rear face of the horn protrusion 112. The second cover formation 123 is shaped to slot into engagement with and complete closure of the rear face as illustrated in the figures.

The shell structure may be attached to the horn protrusion 112 in the following manner. First, the first cover formation 121 is brought over to seat upon the major part of the horn protrusion 112, in particular so that the projection 150 is received in the recess 130. Second, the second cover formation 123 is slotted into place at the back of the first cover formation, in particular so that the projection 151 is received into the slot 131. Suitably, a clamping force may be applied to bringing each projection and recess into suitably close and for example intimate contact. In a convenient embodiment, each of the lip surface 140, 141 on the horn protrusion may be brought directly into intimate face to face contact with the corresponding detent surfaces 152, 153 of the protrusions 150, 151 on the two cover formations. There may then be a small clearance provided to other surfaces of the protrusion/recess arrangement.

Adjacent faces of the two cover formations 121, 123 may then be welded together. In this manner, a stable but passive contact and engagement is effected between the assembled shell structure and the horn protrusion, which can be released by removal of the weld structures between the two cover portions 121, 123.

FIG. 3 is an end elevation of a shell structure as illustrated in FIG. 2 to exemplify the location of a welded connection between the first and second cover formations of the shell structure.

The first cover formation 121 comprises a major part of the assembled shell structure 125 and the second cover formation 123 comprises a minor part. In this embodiment second cover formation comprises a part of a first, rearward end cover portion, and the first cover formation comprises the remainder of the shell structure including the remainder of that end cover portion, first and second side cover portions, a top portion including a tooth formation as above described, and the second, forward end cover portion. The part of the first, rearward end cover portion defined by the first cover formation 125 defines a three-sided trapezoidal slot into which the second cover formation 123 receivingly seats, so that adjacent faces on these three sides of the slot define sites for weld seams 170. The first and second cover formations are thereby non-releasably secured together so as to locate onto the horn protrusion 112 and effect a secure but passive engagement to the horn protrusion by means of the respective projections and recesses.

An assembled drum annulus with three tooth structures is shown in FIG. 4 as a cross-section through A-A of FIG. 3.

It is an essential feature of the invention that each of the first and second cover formations 121, 123 comprise single integral structures when they are assembled in-situ on the horn protrusion 112, and as a result merely need to be disassembled from each other to remove the shell structure from the horn protrusion for replacement. Conveniently, this may be achieved in that each of the two cover formations comprises a one-piece casting. Similarly, the drum annulus 110 including horn protrusions 112 may comprise a single one-piece casting.

However, other methods of fabricating each of the two cover formations into a single integral whole prior to their assembly onto the horn protrusion may be considered.

This allows appropriate material selection for the different components, and in particular allows the use of a hard and wear resistant material for the components making up the shell structure 125, but of a more resilient material for the horn protrusions 112, in a manner which will be familiar to the skilled person from known horn/shell tooth assemblies.

The above arrangement produces a breaker tooth in which a horn protrusion 112 is completely enclosed by the fabricated shell assembly 125 by welding or otherwise non-removably fixing the two and only two cover formations to one another. The shell structure formed by the two cover formations when so assembled together is not non-removably fixed, for example by welding, to the horn protrusion itself. Only the two cover portions are non-removably fixed and for example welded together. The arrangement provides a stably attached breaker tooth shell construction which is securely but passively fixed to the horn protrusion so as to be readily releasable therefrom for replacement in the event of wear or damage. It is only necessary to destructively remove the joint between the two cover portions, for example by gouging the weld surfaces, in order to disassemble the shell structure and release it from the horn for replacement. Removal and replacement times are greatly reduced compared with prior art systems either where the shell structure is welded directly to the horn or where multiple welds between multiple modules of a shell structure need to be gouged.

Figure 5:
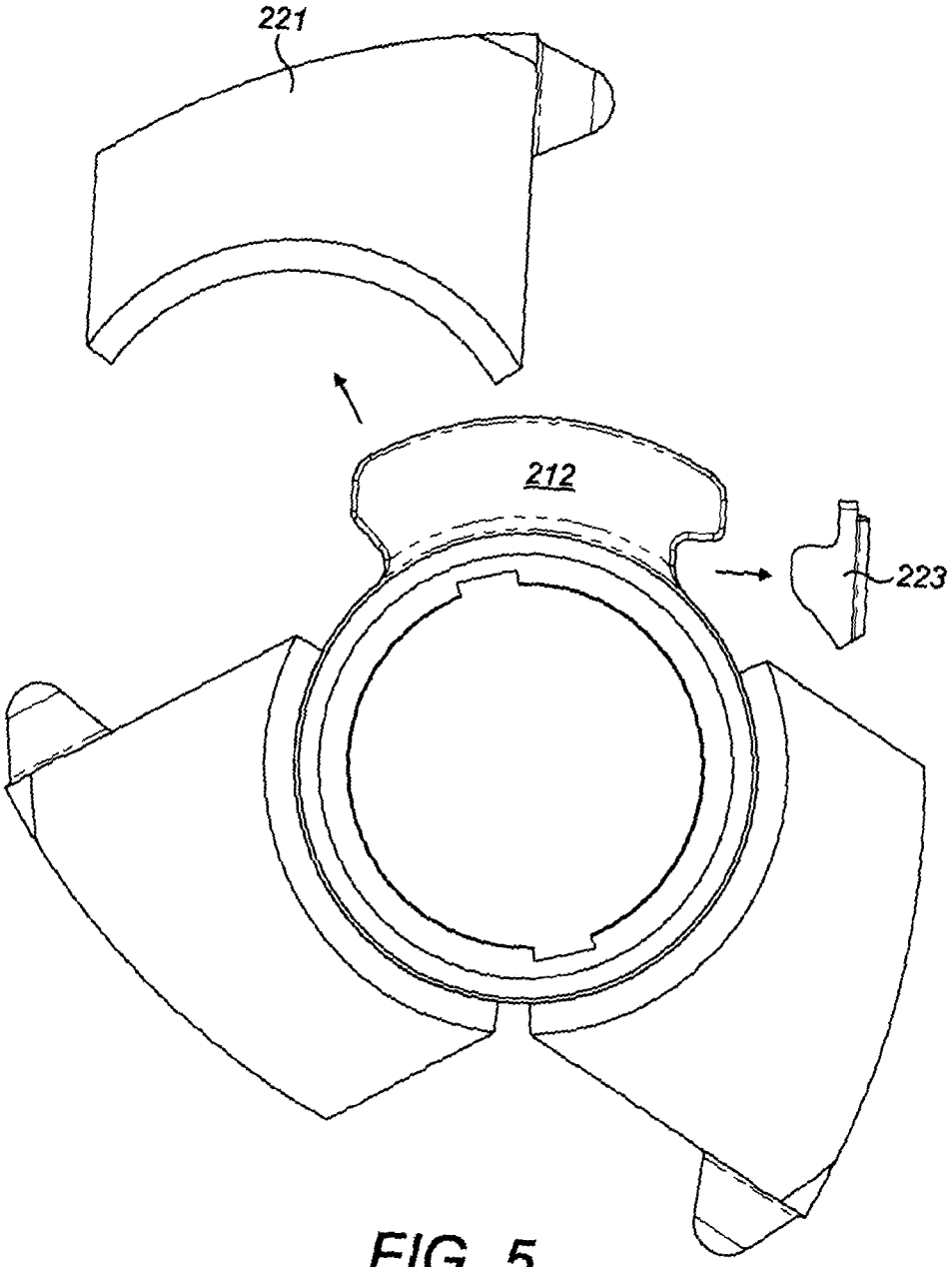
FIG. 5 is a partly disassembled perspective view of an alternative embodiment of the invention.

FIG. 5 illustrates in partly disassembled perspective view an alternative embodiment of the invention. In accordance with FIG. 5, the horn protrusion 212 again receives a first cover portion 221 comprising the bulk of the shell structure, and a second cover portion 223 which slots into and is welded to the first to complete the shell structure, and thereby effect a secure but passive engagement to the horn protrusion by means of respective projections and recesses in similar manner to that illustrated for the first embodiment. The embodiment differs in that the second cover portion 223 seats in and completes the forward part of the shell structure.

Figure 6:
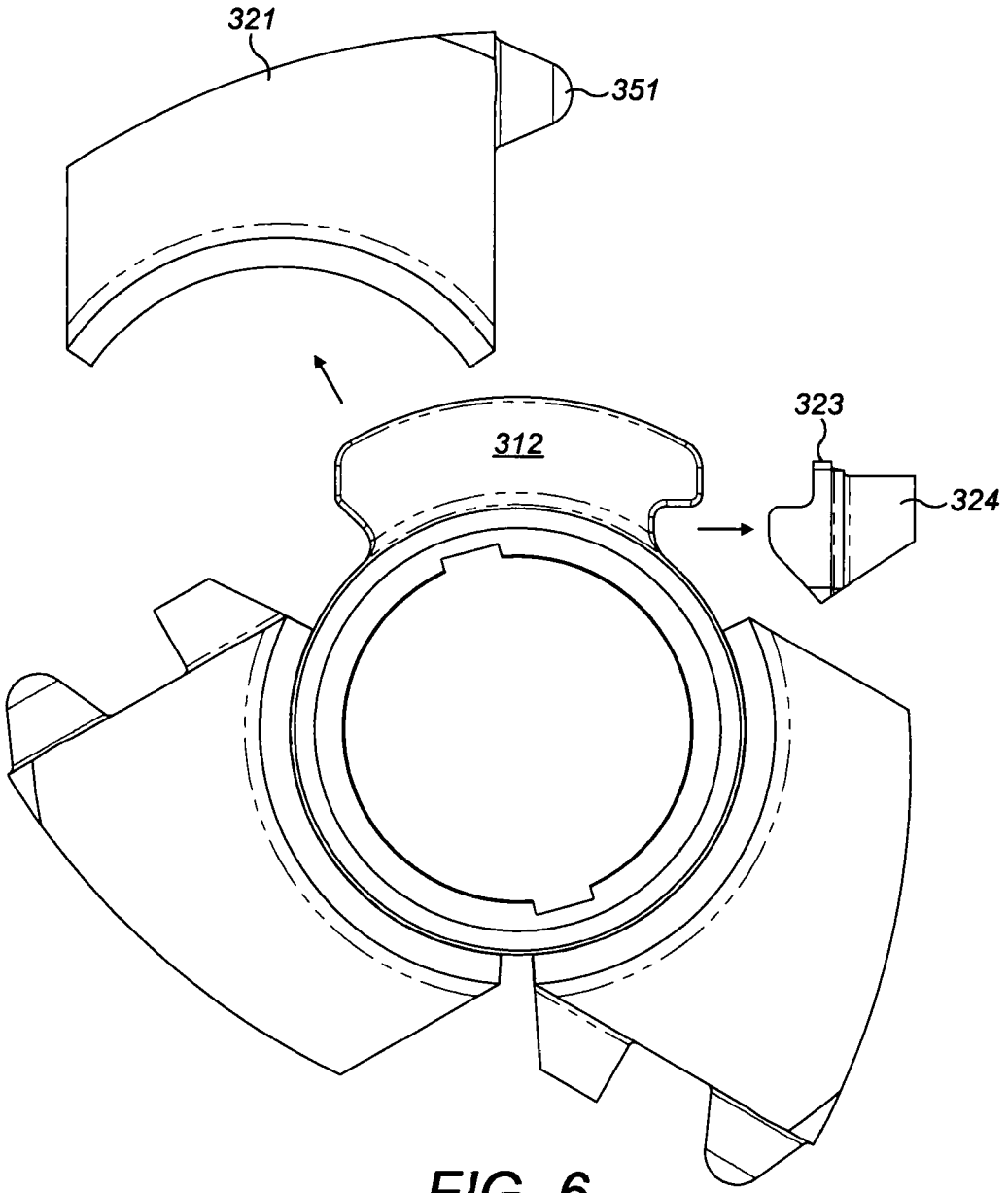
FIG. 6 is a partly disassembled perspective view of an alternative embodiment of the invention.

FIG. 6 illustrates an alternative arrangement to that of FIG. 5 in which a horn protrusion 312 receives a first cover formation 321 and a second cover formation 323 which again slots into the forward face of the horn protrusion, but in this case includes a second breaking tip structure 324 that complements the primary breaking tip structure 351 on the first cover formation 321.

Modifications or improvements may be made to the foregoing without departing from the scope of the present invention.

The invention claimed is:

1. A sizer tooth assembly for a mineral sizer, the sizer tooth assembly comprising: a horn protrusion extending from a rotatable support, the horn protrusion having a pair of opposed front and rear faces; a shell structure encapsulating the horn protrusion and defining an outer shape of the sizer tooth assembly; wherein the shell structure consists of a first cover formation and a second cover formation, the first cover formation and the second cover formation being non-releasably secured to one another but not to the horn protrusion, wherein each of the first cover formation and the second cover formation is a singular integral structure; wherein each of the first and second cover formations seats upon and presents an inward engagement face to a respective one of the pair of opposed front and rear faces of the horn protrusion; and wherein each such inward engagement face of the first and second cover formations and its corresponding face of the horn protrusion are provided with a complementary arrangement of projections and recesses configured to secure the first and second cover formations to the horn protrusion.

2. The sizer tooth assembly in accordance with claim 1, wherein the first and second cover formations are non-releasably secured to one another by a welded joint.

3. The sizer tooth assembly in accordance with claim 1, wherein the first and second cover formations are non-releasably secured to one another by a welded joint on one or more mutually adjacent surfaces.

4. The sizer tooth assembly in accordance with claim 1, wherein a releasable connection is provided by at least one projection, extending from an engagement face of at least one of the first and second cover formations and a corresponding face of the horn protrusion, receivable within at least one complementary recess provided in the adjacent engagement face of at least one of the first and second cover formations and corresponding face of the horn protrusion.

5. The sizer tooth assembly in accordance with claim 4, wherein each cover formation of the first and second cover formations engages upon the horn protrusion in that the projections and recesses are configured such that one or more faces of the respective projections and recesses engage against one another.

6. The sizer tooth assembly in accordance with claim 5, wherein the projections and recesses are configured such that the one or more faces of the respective projections and recesses engage against one another in intimate face to face contact.

7. The sizer tooth assembly in accordance with claim 4, wherein the projections and recesses are configured to engage to create an interference fit.

8. The sizer tooth assembly in accordance with claim 1, wherein the horn protrusion has a pair of opposed side faces and the shell structure as assembled in situ is adapted to overlie at least partly the opposed side faces of the horn protrusion.

9. The sizer tooth assembly in accordance with claim 1, wherein the first cover formation comprises a major part of the shell structure and the second cover formation comprises a minor part of the shell structure.

10. The sizer tooth assembly in accordance with claim 1, wherein the first and second cover formations are provided with joining surfaces configured to be positioned adjacently face to face when each respective cover formation is in position on the horn protrusion.

11. The sizer tooth assembly in accordance with claim 10, wherein the joining surfaces comprise one or more sites for weld seams between and joining the first and second cover formations.

12. The sizer tooth assembly in accordance with claim 1, wherein the first cover formation is configured to receive the second cover formation.

13. A mineral sizer or breaker including a tooth assembly in accordance with claim 1.

14. A drum assembly for a mineral sizer or breaker, the drum assembly including a plurality of toothed annuli mounted on a drive shaft, each annulus having a plurality of tooth assemblies according to claim 1 spaced about its circumference.

15. A mineral sizer or breaker including a drum assembly in accordance with claim 14.

16. A method of assembling a sizer tooth for a mineral sizer or breaker, the method comprising: providing a horn protrusion extending from a rotatable support, the horn protrusion being shaped to define a pair of opposed front and rear faces; providing a shell structure consisting of a first cover formation and a second cover formation, the first cover formation and the second cover formation are configured to be non-releasably secured to one another but not to the horn protrusion to define a unitary sizer tooth assembly, wherein each of the first cover formation and the second cover formation is a singular integral structure; defining on each of the first and second cover formations an inward engagement face which is presented to a respective one of the pair of opposed front and rear faces of the horn protrusion when each of the first and second cover formations seats thereupon, wherein each such engagement face of a cover formation and its corresponding face of the horn protrusion are provided with a complementary arrangement of projections and recesses; and engaging each of the first and second cover formations onto the horn protrusion via the projections and recesses; and non releasably securing first and second cover formations to one another such that the first and second cover formations are secured to the horn protrusion.

17. The method of assembling a sizer tooth in accordance with claim 16, wherein the first and second cover formations are non-releasably secured to one another by welding.

18. The method of assembling a sizer tooth in accordance with claim 17, wherein the first and second cover formations are non-releasably secured to one another by welding one or more mutually adjacent surfaces.

19. The method of assembling a sizer tooth in accordance with claim 16, wherein:

the first cover formation is urged into contact with a first end surface of the horn protrusion via clamping;

the second cover formation is urged into contact with a second end surface of the horn protrusion via clamping; and the first and second cover formations are non-releasably secured to one another by a welded joint.

20. A method of replacement of a shell structure of a tooth assembly fabricated, the method comprising:

destructively removing a welded joint between the first and second cover portions;

providing replacement first and second cover formations; and performing the steps of the method of claim 16 to attach the replacement first and second cover formations in-situ on the horn protrusion.

* * * * *